US009157178B2

(12) United States Patent
Park et al.

(10) Patent No.: US 9,157,178 B2
(45) Date of Patent: Oct. 13, 2015

(54) METHOD FOR CONTROLLING A LAUNDRY TREATMENT APPARATUS ACCORDING TO TARGET RELATIVE HUMIDITY

(75) Inventors: Hye Yong Park, Changwon-si (KR); Yang Hwan Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 632 days.

(21) Appl. No.: 13/515,779

(22) PCT Filed: Dec. 14, 2010

(86) PCT No.: PCT/KR2010/008924
§ 371 (c)(1),
(2), (4) Date: Jun. 13, 2012

(87) PCT Pub. No.: WO2011/074850
PCT Pub. Date: Jun. 23, 2011

(65) Prior Publication Data

US 2012/0324753 A1 Dec. 27, 2012

(30) Foreign Application Priority Data

Dec. 15, 2009 (KR) ..... 10-2009-0124669

(51) Int. Cl.

| | |
|---|---|
| ***F26B 7/00*** | (2006.01) |
| ***D06F 58/10*** | (2006.01) |
| ***D06F 58/20*** | (2006.01) |
| ***D06F 58/28*** | (2006.01) |

(52) U.S. Cl.
CPC ..... *D06F 58/10* (2013.01); *D06F 58/203* (2013.01); *D06F 58/206* (2013.01); *D06F 58/28* (2013.01); *D06F 2058/2819* (2013.01)

(58) Field of Classification Search
CPC ..... D06F 58/10; D06F 58/203; D06F 58/28; D06F 58/206; D06F 2058/2819; D06F 73/00
USPC ..... 34/389, 474, 557
See application file for complete search history.

(56) References Cited

U.S. PATENT DOCUMENTS

| | | | | |
|---|---|---|---|---|
| 2003/0223309 | A1 | 12/2003 | Hapke | |
| 2006/0037209 | A1 | 2/2006 | Johnson et al. | |
| 2008/0148596 | A1 | 6/2008 | Son et al. | |
| 2008/0155757 | A1 | 7/2008 | Kim et al. | |
| 2009/0071032 | A1 * | 3/2009 | Kreutzfeldt et al. | 34/389 |

(Continued)

FOREIGN PATENT DOCUMENTS

| | | |
|---|---|---|
| CN | 1766217 | 5/2006 |
| EP | 1790768 | 5/2007 |

(Continued)

*Primary Examiner* — Kenneth Rinehart
*Assistant Examiner* — Bao D Nguyen
(74) *Attorney, Agent, or Firm* — Dentons US LLP

(57) ABSTRACT

A control method of a laundry treatment apparatus configures to supply steam and/or heated air to an accommodating space accommodating laundry therein is disclosed. The method includes a water supplying step (S100) supplying water to a steam generating device configured to supply steam, a preheating step (S120), a steam supplying/applying a predetermined motion to the laundry step (S140) heating the water to supply steam to the accommodating space and applying a motion to the laundry for a predetermined time period simultaneously, a cooling step (S160) cooling the accommodating space, and a drying step setting a target relative humidity according to a selected course and supplying heated air to the accommodating space (S180).

15 Claims, 8 Drawing Sheets

(56) References Cited

U.S. PATENT DOCUMENTS

| | | | | |
|---|---|---|---|---|
| 2009/0126423 | A1 | 5/2009 | Bae et al. | |
| 2009/0282696 | A1 | 11/2009 | Kim et al. | |
| 2010/0050467 | A1 * | 3/2010 | Lee | 34/499 |

FOREIGN PATENT DOCUMENTS

| | | | |
|---|---|---|---|
| EP | 1790769 | A1 | 5/2007 |
| KR | 20090100802 | A | 9/2009 |
| KR | 20090114781 | A | 11/2009 |

* cited by examiner

METHOD FOR CONTROLLING A LAUNDRY TREATMENT APPARATUS ACCORDING TO TARGET RELATIVE HUMIDITY

This application is a National Stage Entry of International Application No. PCT/KR2010/008924, filed Dec. 14, 2010, and claims the benefit of Korean Application No. 10-2009-0124669, filed on Dec. 15, 2009, each of which is hereby incorporated by reference for all purposes as if fully set forth herein.

TECHNICAL FIELD

The present invention relates to a control method configured to supply moisture, mist and steam to clothes to perform sanitization for clothes.

BACKGROUND ART

In recent, various kinds of laundry treatment apparatuses are used together with washing machines used to wash laundry items including clothes, cloth items, beddings and the like. For example, there have been developed a variety of laundry treatment apparatuses including drum type dryers capable of drying laundry items having being washed, cabinet type dryers capable of drying laundry items hung thereon, and refreshers capable of refreshing laundry items by using hot air supplied to the laundry items.

However, such a cabinet type laundry treatment apparatus has a variety of disadvantages.

DISCLOSURE OF INVENTION

Technical Problem

Accordingly, the present invention is directed to a control method of a laundry treatment apparatus.

An object of the present invention is to provide a control method of a laundry treatment apparatus, which can perform drying for laundry by supplying of air or steam to the laundry.

Solution to Problem

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control method of a laundry treatment apparatus configured to supply steam and/or heated air to an accommodating space accommodating laundry therein, the control method includes a water supplying step supplying water to a steam generating device configured to supply steam, a steam supplying/applying a predetermined motion to the laundry heating the water to supply steam to the accommodating space and applying a motion to the laundry for a predetermined time period simultaneously, a cooling step cooling the accommodating space, and a drying step setting a target relative humidity according to a selected course and supplying heated air to the accommodating space.

Advantageous Effects of Invention

According to the control method of the laundry treatment apparatus of the present invention, air or steam may be supplied to laundry. As a result, drying for the laundry may be performed efficiently.

It is to be understood that both the foregoing general description and the following detailed description of the present invention are exemplary and explanatory and are intended to provide further explanation of the invention as claimed.

BRIEF DESCRIPTION OF DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

This specification embodies a refresher configured to refresh clothes, with being capable of supplying heated air, as laundry treatment apparatus and the present invention is not limited thereto. A subject matter of the present invention may be applicable to any devices having a heat pump which will be described later. Here, 'refresh' means a process of performing wrinkle removal, deodorization, static electricity prevention and laundry warming and the like by supplying air, heated air, water, mist and steam to clothes, cloth items and the like (hereinafter, referenced to as 'laundry'). the term 'laundry' includes clothes, apparel, shoes, socks, gloves, hats and mufflers which are wearable by people and dolls, towels and beddings which useable. That is, 'laundry' includes all kinds of objects of which washing may be performed.

Figure 1:
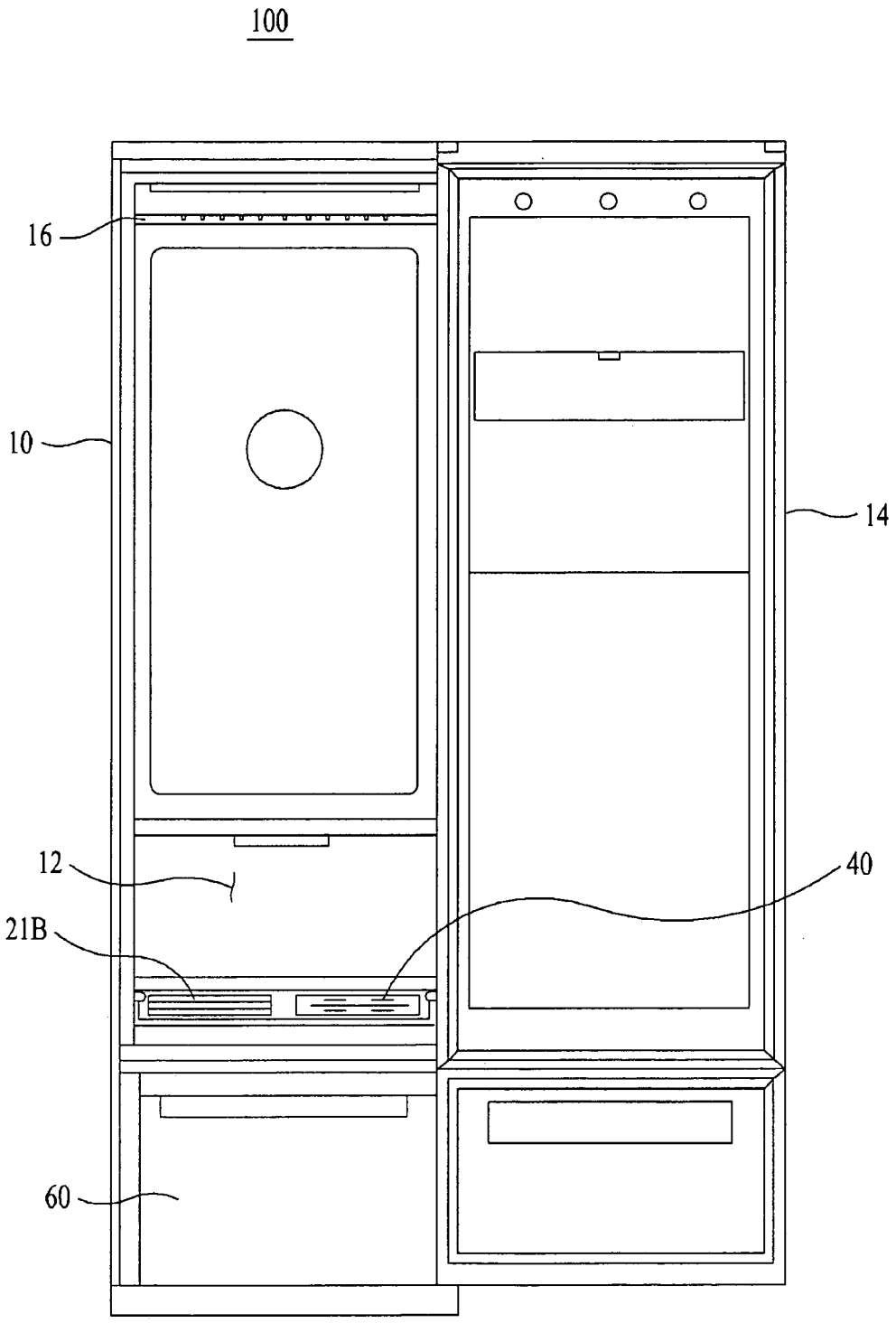
FIG. 1 is a front view illustrating a door 14 provided in a laundry treatment apparatus, in an open state.

In reference to FIG. 1, a laundry treatment apparatus 100 includes a cabinet 10 having a predetermined accommodating space 12 formed therein to accommodate laundry, an air supplying device (22, see FIG. 2) configured to supply air or heated air to the accommodating space 12, a steam generating device (30, see FIG. 2) configured to spray water, mist or steam to the accommodating space 12 selectively, and a control part (not shown) configured to control the air supplying device 22 and the steam generating device 30.

A variety of components, which will be described later, are provided in the cabinet 10 and the accommodating space 12 is formed in the cabinet 10 to accommodate laundry therein. The accommodating space 12 is selectively in communication with an outside by a door 14. Various supporters 16 may be provided in the accommodating space 12 to hang clothes thereon. The supporters 16 are configured to stand still or to maintain a fixed state to keep the clothes motionless. Here, the supporters may be configured to apply predetermined movement to the clothes when air, heated air, water, mist or steam is supplied to the clothes, which will be described later. In reference to FIGS. 2 and 3, this configuration will be described as follows.

Figure 2:
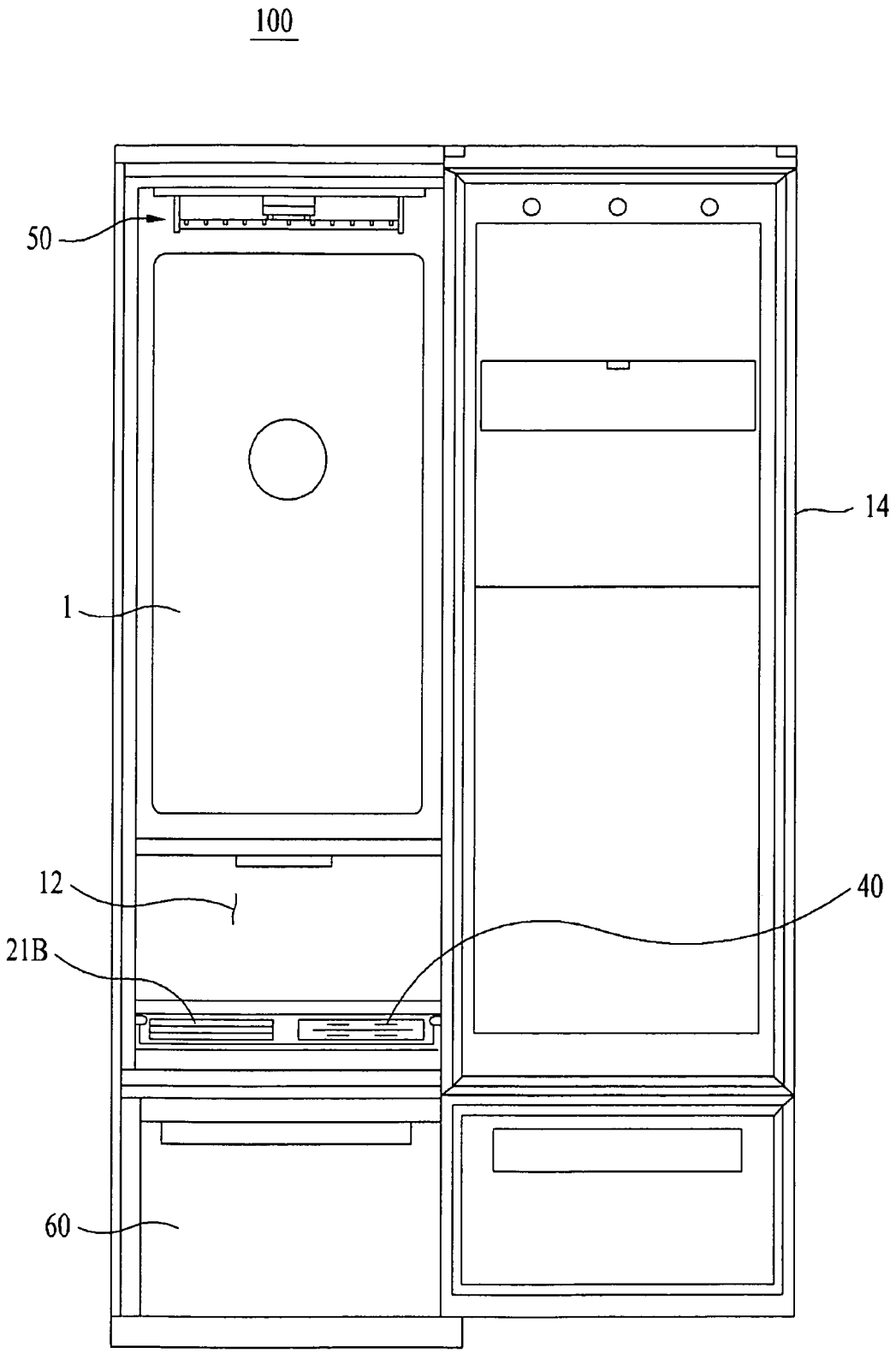
FIG. 2 is a front view illustrating a laundry treatment apparatus according to another embodiment of the present invention.

FIG. 2 is a front view illustrating a laundry treatment apparatus according to another embodiment of the present invention. Compared with the above embodiment, the laundry treatment apparatus according to this embodiment includes a moving hanger configured to apply a predetermined motion to clothes hung thereon. As follows, this difference will be described in detail.

In reference to FIG. 2, laundry is hung on a moving hanger 50 provided in the accommodating space 12 and the moving hanger 50 is configured to apply a predetermined motion to the laundry hung thereon. If the predetermined motion is applied to the laundry supplied air, heated air, water, mist or steam, the effect of laundry refreshing may be enhanced.

Figure 3:
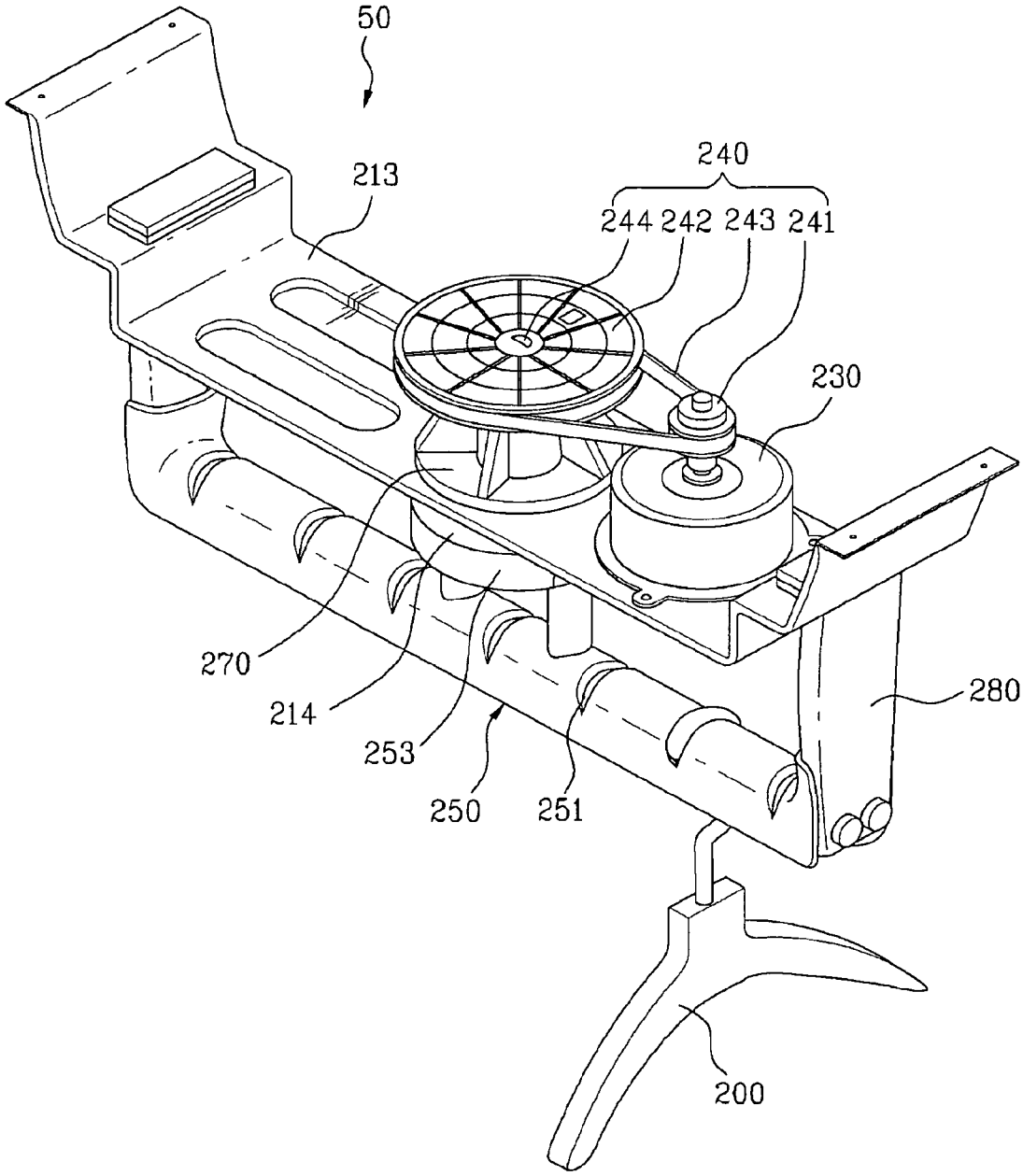
FIG. 3 is a perspective view illustrating a moving hanger shown in FIG. 2.
Figure 4:
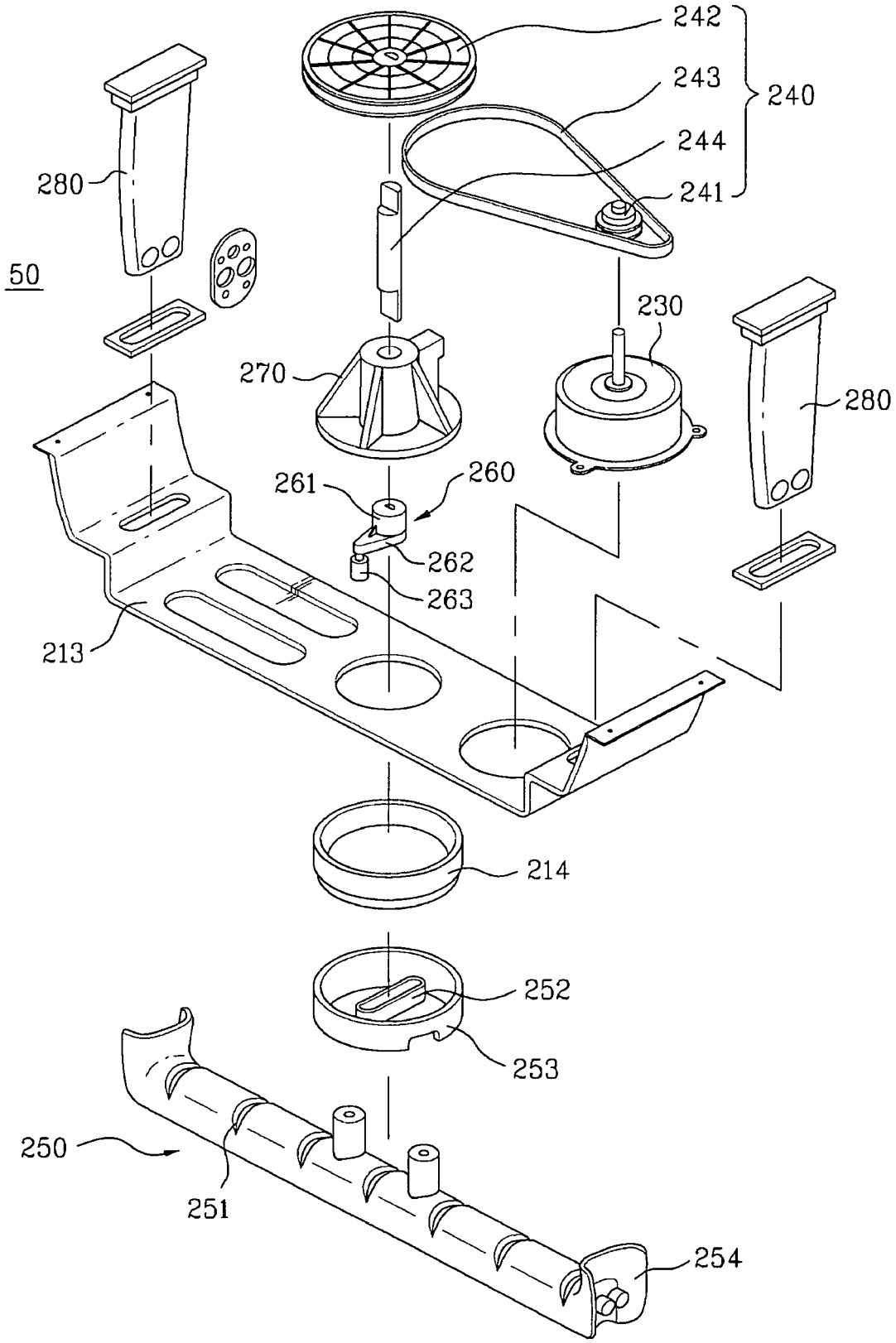
FIG. 4 is an exploded perspective view of FIG. 3.

FIG. 3 is a perspective view illustrating the moving hanger 50 and FIG. 4 is an exploded perspective view illustrating the moving hanger 50.

In reference to FIGS. 3 and 4, the moving hanger 50 includes a hanger bar 250 configured to support laundry hung on a hanger 200 and a supporting part 280 configured to support both ends of the hanger bar 250. A plurality of hanger recesses 251 may be provided in the banger bar 250 to fix the location of the hanger 200 hung on the hanger bar 250. The supporting part 280 is connected to a moving hanger frame 213 and the moving hanger frame 213 is provided beyond a ceiling of the cabinet 10, not to be seen outside. Both ends of the hanger bar 250 include supporting part ribs 254, respectively, and the supporting rib 254 is covering the end of the supporting part 280.

As a result, the clothes received in the laundry treatment apparatus according to the present invention are hung on at least one hanger. Because of that, not only an improved refreshing effect but also improved drying efficiency for the clothes may be expected, compared with the conventional laundry treatment apparatus.

In the meanwhile, the moving hanger 50 includes a motor 230, a power converting part 260 configured to convert a rotational force provided by the motor 230 into a horizontally linear motion of the hanger bar 250, and a power transmitting part 240 configured to transmit the power generated from the motor 230 to the power transmitting part 260.

The power transmitting part 240 includes a driving pulley 241 provided in the motor 230, a driven pulley 242 connected to the driving pulley 241 by a belt 243, and a shaft 244 coupled to a center of the driving pulley 242. The shaft 244 may be rotatably provided in a bearing housing 270 provided in the moving hanger frame 213.

The hanger bar 250 may further include a slot 252 which lies at right angles to its longitudinal direction. Specifically, a slot housing 253 is provided on the hanger bar 250 and the slot 252 is located approximately in a center of the slot housing 252. The power converting part 260 may include a slot inserting portion 263 inserted in the slot 252, a shaft connecting portion 261 connected to the shaft 244 and a rotation arm 262 connecting the slot inserting portion 263 and the shaft connecting portion 261 with each other. The power converting part 260 is covered by a cover 214 not to be seen outside and the cover 214 is provided between the moving hanger frame 213 and the slot housing 253.

Under this configuration, when the motor 230 is rotated, the driving pulley 242 is rotated and the shaft 244 coupled to the driving pulley 242 is rotated. At this time, the slot inserting portion 263 will perform a circular motion, with a predetermined diameter.

Here, the slot 252 provided in the hanger bar 250 may be orthogonal to the longitudinal direction of the hanger bar 250. By extension, the length of the slot 252 is larger than a rotational locus of the slot connecting portion 263. Because of that, the slot 252 may perform a linear motion along a horizontal direction even when the slot inserting portion 263 performs a circular motion.

In the meanwhile, a mechanism chamber 20 configured to accommodate the air supplying device 22 and the steam generating device 30 may be provided in the cabinet 10. The mechanism chamber 20 may be located below the accommodating space 12 and it includes the air supplying device 22 and the steam generating device 30 received therein. The reason why the mechanism chamber 20 is located below the accommodating space 12 is that the heated air or steam supplied to the accommodating space 12 has a property of ascending and that the mechanism chamber 20 is located below the accommodating space 12 to supply the heated air or steam upwardly.

Figure 5:
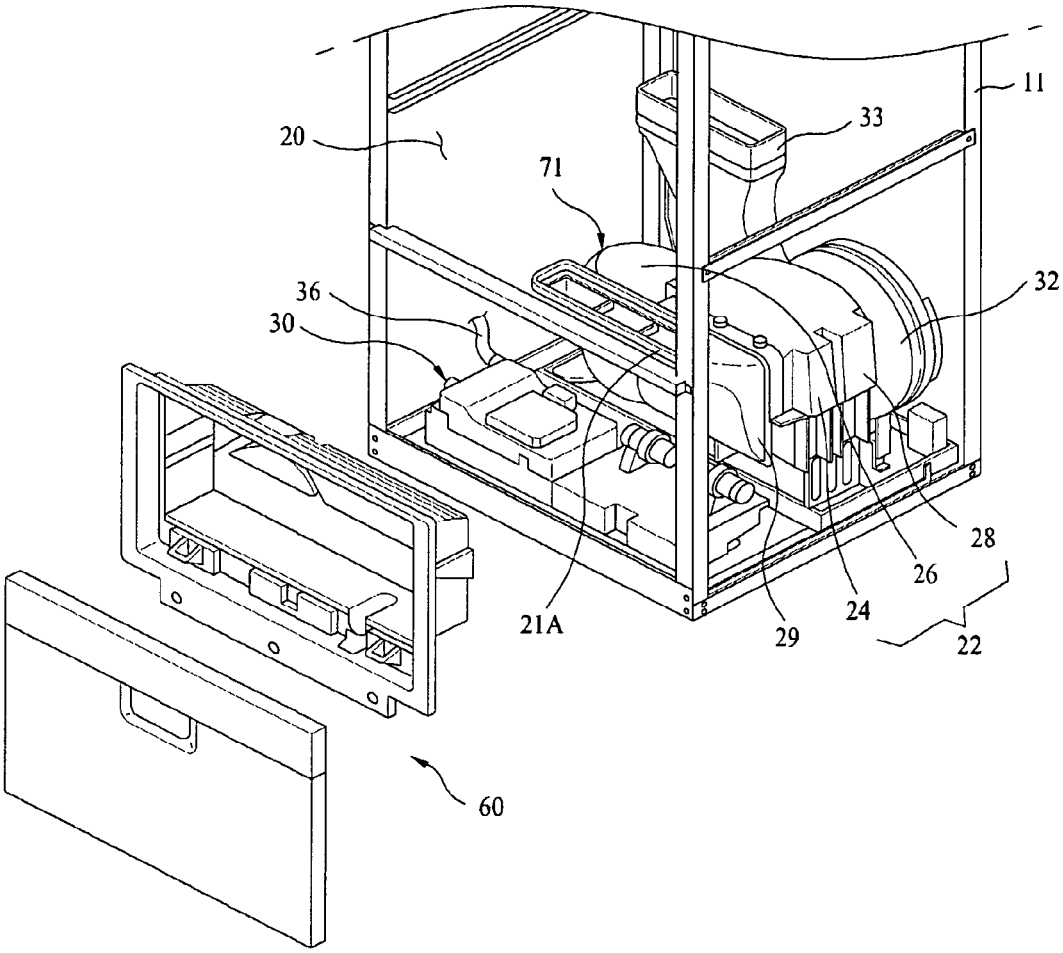
FIG. 5 is a schematic diagram illustrating an inner configuration of a mechanism chamber.

FIG. 5 is a perspective view schematically illustrating an inner configuration of the mechanism chamber 20. To illustrate the inner configuration of the mechanism chamber 20, only a frame 11 of the cabinet 10 is shown in FIG. 5 for convenience sake. In addition, only main components including the air supplying device 22 and the steam generating device 30 are illustrated in FIG. 5 for convenience sake and a drainage line connecting those components with each other is not illustrated.

In reference to FIG. 5, the air supplying device 22 configured to supply air or heated air to the accommodating space 12 may be located within the mechanism chamber 20.

A heat pump 22 embodied as the air supplying device according to the present invention may include an evaporator 24, a compressor 26, a condenser 28 and an expansion valve (not shown) which allow refrigerant to flow there through. Because of that, air is dehumidified and heated.

In other words, latent heat of ambient air is absorbed, while refrigerant is evaporated in the evaporator 24. After that, air is cooled and moisture contained in the air is condensed and eliminated. When refrigerant is condensed in the condenser 28 after passing the compressor 26, latent heat is exhausted toward ambient air. After that, the ambient air may be heated. As a result, the evaporator and the condenser 28 are functioned as heat exchanger. The air sucked into the mechanism chamber 20 may be dehumidified and heated while passing the evaporator 24 and the condenser 28, to be supplied to the accommodating space 12.

The air heated by the heat pump 22 has a relatively lower temperature than the air heated by a conventional electric heater. However, the air heated by the heat pump 22 may be dehumidified without using any auxiliary dehumidifying device. As a result, the air re-supplied to the accommodating space 12 by the heat pump 22 may be corresponding to 'relatively low dry air' (here, the term of 'low temperature' means not an absolutely low temperature but a relatively lower temperature than the temperature of conventional heated air). The laundry treatment apparatus according to the embodiment of the present invention may supply low temperature dry air to the laundry. Because of that, the laundry treatment apparatus according to the embodiment of the present invention may prevent deformity or damage which might be generated by the high temperature of heated air used in performing refreshing or drying for the laundry. That is, the air supplied by the heat pump 22 in the laundry treatment apparatus according to the embodiment of the present invention may have the lower temperature than the hot air supplied in the conventional laundry treatment apparatus but it may be dehumidified without any auxiliary dehumidifying device, to dry and refresh the laundry efficiently and smoothly.

Specifically, an air inlet (21A, see FIG. 5) is formed in a front portion of a top of the mechanism chamber 20 suck air of the accommodating space 12 into the mechanism chamber 20. An air path of the air may be formed by an inlet duct 29 configured to connect the air inlet 21A, the evaporator 24, the condenser 28 and the fan 32 with each other. The air drawn into the mechanism chamber 20 via the air inlet 21A by the inlet duct 29 may be dehumidified and heated while passing the heat pump 22. The dehumidified and heated air may be re-supplied to the accommodating space 12 via an outlet duct 33 and an air outlet 21B by a fan 32.

Here, although not shown in the drawings, a filter may be provided in the air inlet 21A. The filter provided in the air inlet 21A may filter various foreign substances contained in the air drawn into the mechanism chamber 20 from the accommodating space 12 and only fresh air can be re-supplied to the accommodating space 12.

Furthermore, the steam generating device 30 may be provided in the mechanism chamber 20 to supply water, mist or steam (hereinafter, referenced to as 'steam') to the accommodating space 12 selectively.

The steam generating device 30 includes a heater (not shown) configured to heat water and the water is heated to generate steam. The steam generating device 30 supplies the generated steam to the accommodating space 12. An external water tap may be used as water supply source supplying water to the steam generating device 30 or a water supplying tank (not shown) may be provided in a predetermined portion of the mechanism chamber 20 as water supply source.

The water supplying tank may be provided in a door module 60 detachably installed in a predetermined portion of the mechanism chamber 20. Because of that, a user may separate the water supplying tank from the mechanism chamber 20 for water refill and he or she may re-install the tank.

Also, the steam generated in the steam generating device 30 is supplied to the accommodating space 12 via a steam hose 36 and a steam nozzle (40, see FIGS. 1 and 2). In this case, it is more preferable, as the shorter the steam hose 36 is, to prevent the temperature of the steam from being lowered or condensed while the steam moving through the steam hose 36. When the mechanism chamber 20 is located below the accommodating space 12, the steam nozzle 40 may supply steam via a top of the mechanism chamber 20 which is a bottom of the accommodating space 12.

A circulating fan (not shown) may be provided in a rear portion of the mechanism chamber 20 and the circulating fan supplies external air to the mechanism chamber 20. Because of that, the internal air of the mechanism chamber 20 may be prevented from increasing too much when the heat pump 22 and the steam generating device 30 are put into operation.

As follows, a control method of the laundry treatment apparatus having the configured described above will be described. The control method which will be described as follows is a control method performed when a course for sanitizing the laundry, namely, a sanitizing course out of refreshing courses is selected.

Figure 6:
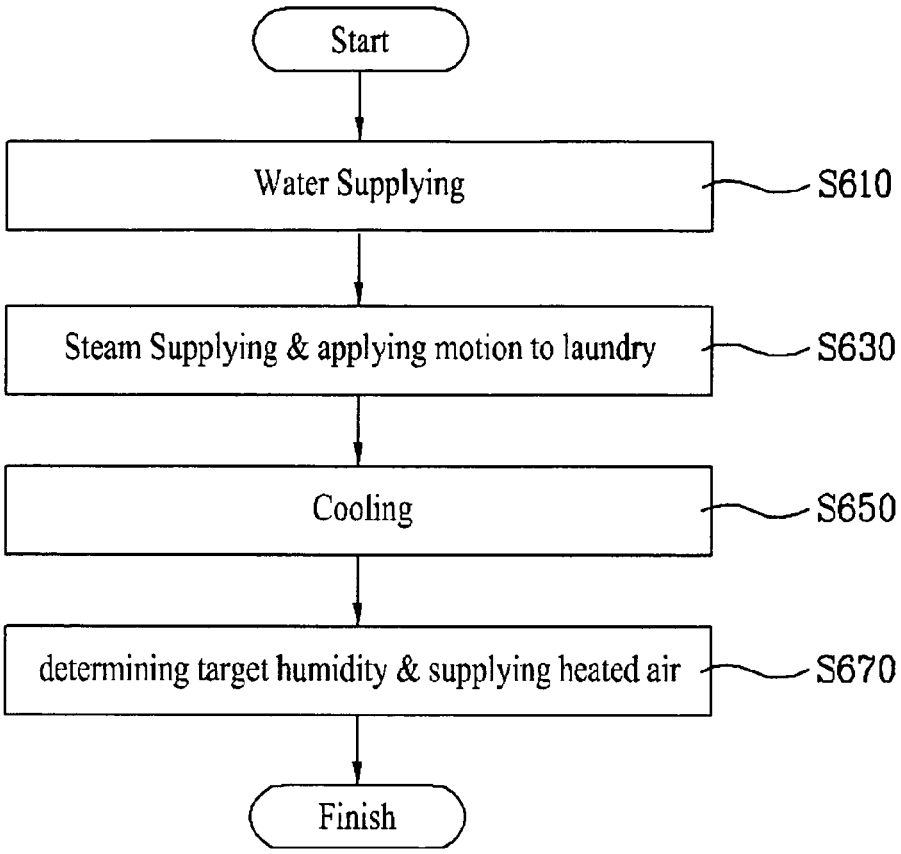
FIG. 6 is a flow chart illustrating a control method according to an embodiment of the present invention.

FIG. 6 is a flow chart illustrating a control method according to an embodiment of the present invention.

In reference to FIG. 6, the control method according to this embodiment includes a step supplying water to the steam generating device configured to supply steam to the accommodating space (S610), a step supplying steam by heating of the water inside the steam generating device and applying a motion to the laundry for a predetermined time period (S630), a cooling step cooling the accommodating space (S650) and a drying step presetting a target relative humidity according to a selected course and supplying heated air to the accommodating space 12.

First of all, the control part supplies water to the steam generating device 30 (S610). In this case, the control part controls the water to be supplied to a full-water level of the steam generating device. For that, a water level sensor may be provided in the steam generating device to detect a water level. The control part controls the water to be supplied to the steam generating device until the water level sensor detects that the water reaches the full-water level.

Here, the control part may further include heating the water until the temperature of the water reaches a predetermined temperature in the water supplying step. This step is configured to reduce the time required to heat the water to generate steam in a steam generating step which will be described later. The water may be heated at the moment when the water is supplied or in a predetermined time after the water is supplied. A heater and the like may be provided in the steam generating device to heat the water.

Hence, the control part heats the water inside the steam generating device and it supplies steam to the accommodating space, simultaneously with applying a predetermined horizontal motion to the laundry (S630). The control part uses the heater provided in the steam generating device to heat the water and it supplies steam to the accommodating space. In the meanwhile, simultaneously with supplying steam to the accommodating space, the control part drives the moving hanger 50 to apply the horizontal motion to the laundry. Especially, the control part drives the moving hanger 50 to apply a horizontal motion to the laundry with a preset RPM, for example, a horizontally linear motion, a horizontally closed curve motion and a horizontally reciprocating motion. The motion is applied to the laundry, simultaneously together with supplying the steam to the laundry. Compared with the laundry kept still without any motion, the laundry having the predetermined motion applied thereto may contact with more steam and the effects of wrinkle removal, deodorization and static electricity prevention may be remarkably improved. The steam supplying time may be adjustable properly according to the kind of the laundry, the kind of fabric, a property of fabric. The steam supplying time determined according to the kind of the laundry may be stored in the control part in advance. The laundry moving time may be continued or periodically repeated for the steam supplying time.

After supplying steam, the control part controls unheated air to be supplied to the laundry for a predetermined time period to perform laundry cooling (S650). Only the fan 32 is operated, not the heat pump 22, and unheated air is supplied to the accommodating space 12 to perform the cooling. Because of that, it is possible to lower the internal temperature of the accommodated space 12 heated by the steam supplied thereto and the temperature of the laundry.

Hence, the control part controls air heated or dried by the heat pump 22 to the accommodating space 12, to dry the laundry (S670). In case of supplying heated air to dry the laundry, the step of applying the motion to the laundry in the drying step may be provided. That is, In other words, the control part may apply a predetermined motion to the laundry when supplying the heated air to the accommodating space 12. The motion is applied to the laundry, simultaneously together with supplying the heated air and the laundry having the predetermined motion applied thereto may contact with more heated air and drying efficiency may be remarkably improved. The step applying the predetermined motion to the laundry may be performed by driving of the moving hanger 50 and this is similar to the laundry motion performed in the steam supplying step described above and repeated description thereof will be omitted accordingly.

In the meanwhile, when supplying heated air to the accommodating space to dry the laundry, the control part sets a target relative humidity according to a selected course and then it supplies the heated air. A humidity sensor is used to determine whether the drying of the laundry is complete, in case of drying the laundry. that is, the humidity sensor measures the amount of humidity contained in the air having passes the laundry and it is determined whether the drying of the laundry is completed.

However, even if the amount of water contained in the total laundry (water amount) is regular, it is known from experiments performed by the inventor of the present invention that the relative humidity amount of air is varied according to the amount of laundry items accommodated in the accommodating space (laundry amount). In other words, even if the water amount is regular, the relative humidity of air is getting higher as the laundry amount is getting larger and it is getting lower as the laundry amount is getting smaller. Because of that, the moisture contained in the laundry has a high chance of being distributed in the air. When determining the completion of the laundry drying with respect to the relative humidity contained in the air, a target relative humidity is set according to a selected course uniformly and then the laundry drying is performed. In this case, even when the target relative humidity is reached, the moisture amount actually remaining in the laundry may have severe deviation according to the laundry amount. As a result, it is required to control the remaining water amount to have no deviation regardless of the laundry amount when completing the laundry drying.

Figure 7:
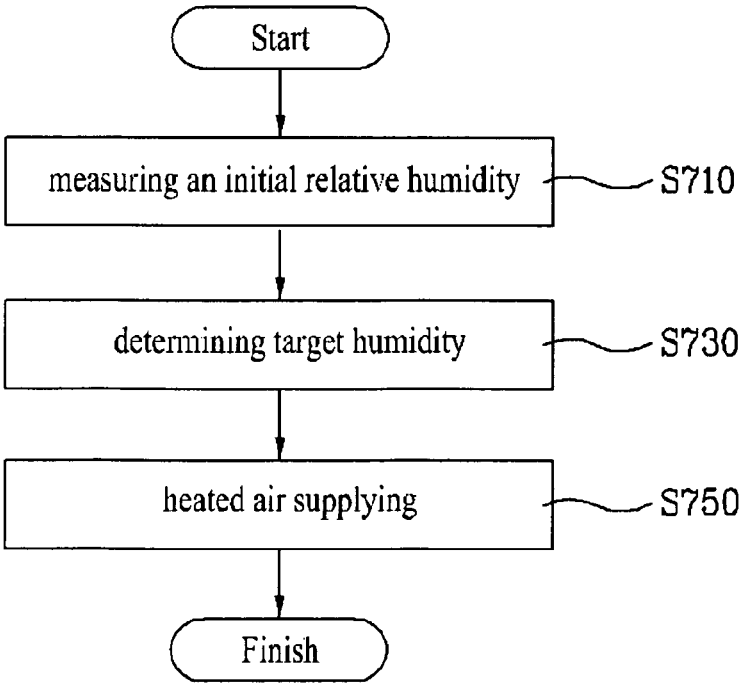
FIG. 7 is a flow chart specifically illustrating a target humidity determining step and a heated air supplying step shown in FIG. 6.

FIG. 7 is a flow chart illustrating the drying step (S670).

In reference to FIG. 7, the drying step (S670) includes a humidity measuring step (S710) measuring a relative humidity of the accommodating space accommodating the laundry therein, a target humidity setting step (S730) determining a target relative humidity used to dry the laundry based on the measured relative humidity, and a heated air supplying step (S750) supplying heated air to the accommodating space based on the target relative humidity.

First of all, a user selects one of two or more drying courses including the drying step.

Hence, the control part of the laundry treatment apparatus measures a relative humidity of the accommodating space having the laundry accommodated therein (S710). This is to measure a relative humidity of the space including the laundry in an initial stage of the heated air supplying and to determine a target relative humidity according to the measured relative humidity. As mentioned above, when the target is set uniformly according to the selected course, there would be severe deviation of the moisture amount contained in the laundry even after completing the drying according to the laundry amount. Because of that, the target relative humidity is not set uniformly according to this embodiment and the relative humidity of the space having the laundry therein is measured in the initial stage of the drying and the target relative humidity is determined based on the measured relative humidity. When determining the target relative humidity, the relative humidity measured in the initial stage of the drying step is used as element and then the deviation of the water amount remaining in the laundry amount even after completing the drying step may be reduced.

When measuring the relative humidity, the humidity sensor provided in the laundry treatment apparatus is used to sense the relative humidity. The humidity sensor may sense the humidity of air having passes the laundry and it may be provided adjacent to the air inlet 21A. when sensing the relative humidity by using the humidity sensor simultaneously with the supplying the heated air, values sensed by the humidity sensor would not be accurate. Since the humidity sensor is operated together with the heated air supplying, the humidity sensor is not stabilized. Because of that, the control method according to this embodiment includes a step stabilizing the humidity sensor for a predetermined time period after supplying heated air. For example, the heated air is supplied for 3 to 5 minutes in the stabilizing step. hence, the control part measures the relative humidity by using the humidity sensor. when measuring the relative humidity, the control part uses the humidity sensor to measure the relative humidity for a predetermined time period and it determines an average value as measured humidity.

After measuring the relative humidity, the control part determines the target relative humidity (S730). The control part determines the target relative humidity according to the measured relative humidity value and it determines a target relative humidity according to a selected course.

Specifically, the control part determines a predetermined value having a predetermined difference (A) with respect to the measured relative humidity values as target relative humidity value. For example, if the relative humidity value measured in the initial stage of the drying step is 60%, the target relative humidity value is determined to be a value remaining after subtracting 'A' from 60%.

In the meanwhile, the predetermined value 'A' may be adjustable properly according to the selected course. For example, if strong drying is requested, 'A' may be determined to be a relatively large value. In an ironing course, the user may be expected to iron the laundry after the drying step. because of that, 'A' may be set to be a relatively small value. In case of a standard drying, 'A' may be set to be smaller than in the strong drying and larger than in the ironing course.

After determining the target relative humidity, the control part supplies heated air to the accommodating space by using the air supplying device 22. the control part controls the relative humidity of air to be measured by the humidity sensor continuously or periodically, simultaneously with supplying the heated air. The control part determines that the drying is completed if the relative humidity sensed by the humidity sensor reaches the target relative humidity and then it stops the operation of the air supplying device, to complete the drying step.

However, if heated air is supplied after the target relative humidity is determined based on the relative humidity value sensed in the initial stage of the drying step, the drying for the laundry might be performed too much (over-drying) or the drying might be finished without performing enough drying. For example, if the relative humidity measured in the initial stage is too high, the target relative humidity value is relatively high only to finish the drying without enough drying. In contrast, if the relative humidity value measured in the initial stage is too low, the target relative humidity value might be set too low only to perform over-drying. If such the over-drying and insufficient drying occur, the target relative humidity would be variable by various elements, for example, the temperature near/inside the laundry treatment apparatus, the relative humidity of air, the amount/quality of laundry.

Because of that, an embodiment to prevent the over-drying and insufficient drying will be described.

Figure 8:
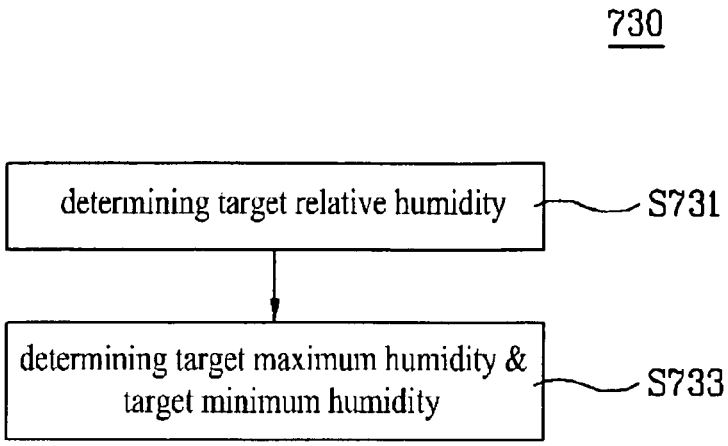
FIG. 8 is a flow chart illustrating a target humidity determining step according to another embodiment.
Figure 9:
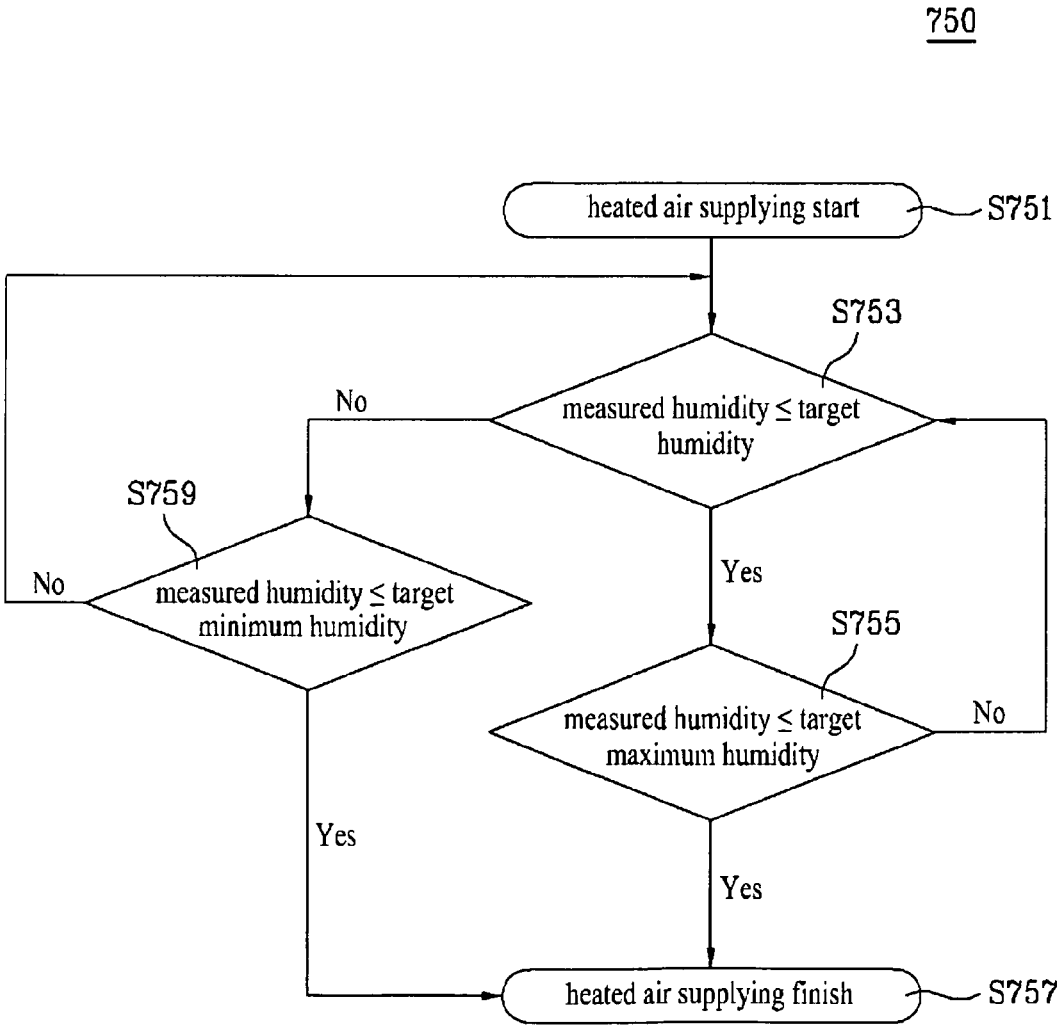
FIG. 9 is a flow chart specifically illustrating a heated air supplying step according to another embodiment.

FIGS. 8 and 9 are flow charts illustrating an embodiment to prevent the over-drying and the insufficient drying.

In reference to FIG. 8, the drying step according to this embodiment includes a step (S731) determining a target relative humidity in the target humidity determining step and a step (S733) determining a target maximum humidity and/or a target minimum humidity. the target maximum humidity is to prevent the insufficient drying and the target minimum humidity is to prevent the over-drying.

The target maximum humidity and the target minimum humidity may be set properly according to a selected course, regardless of the relative humidity value measured in the initial stage of the drying. For example, the target maximum humidity may be set to be smaller in the order of an ironing course, a standard course and a strong course. The target minimum humidity may be set to be smaller in the order of the ironing course, the standard course and the strong course. Here, the target maximum humidity may be set to be larger than the target minimum humidity in a single course.

FIG. 9 is a flow chart illustrating the heated air supplying step supplying heated air in the drying step.

In reference to FIG. 9, the control part starts to supply heated air and it measures a relative humidity continuously or periodically, to compare the measured relative humidity with a target humidity (S753). In this case, when the measured humidity value is less than the target relative humidity, the control part re-compares the measured humidity value with the target maximum humidity value, without finishing the heated air supplying step (S755). This is because the drying is prevented from finishing, with much moisture contained in the laundry, when the relative humidity measured in the initial stage is relatively high enough to set the target relative humidity to be a high value. As a result, the control part supplies heated air continuously until the measured relative humidity is lower than the target maximum humidity even it is lower than the target relative humidity. the control part finishes the heated air supplying when the measured relative humidity is lower than the target maximum humidity as well as the target relative humidity (S577).

In the meanwhile, the control part compares the measured relative humidity with the target minimum humidity even when the measured relative humidity is the target relative humidity or more (S759). In case the relative humidity value measured in the initial stage is relatively low enough to set the target relative humidity to be too low, the control part finishes the heated air supplying step when the relative humidity reaches the target minimum humidity set according to the selected course before reaching the target relative humidity, to prevent the over-drying. As a result, the control part determines that the drying is completed, when the measured relative humidity value is lower than the target minimum humidity, even with the measured relative humidity value not reaching the target relative humidity.

Figure 10:
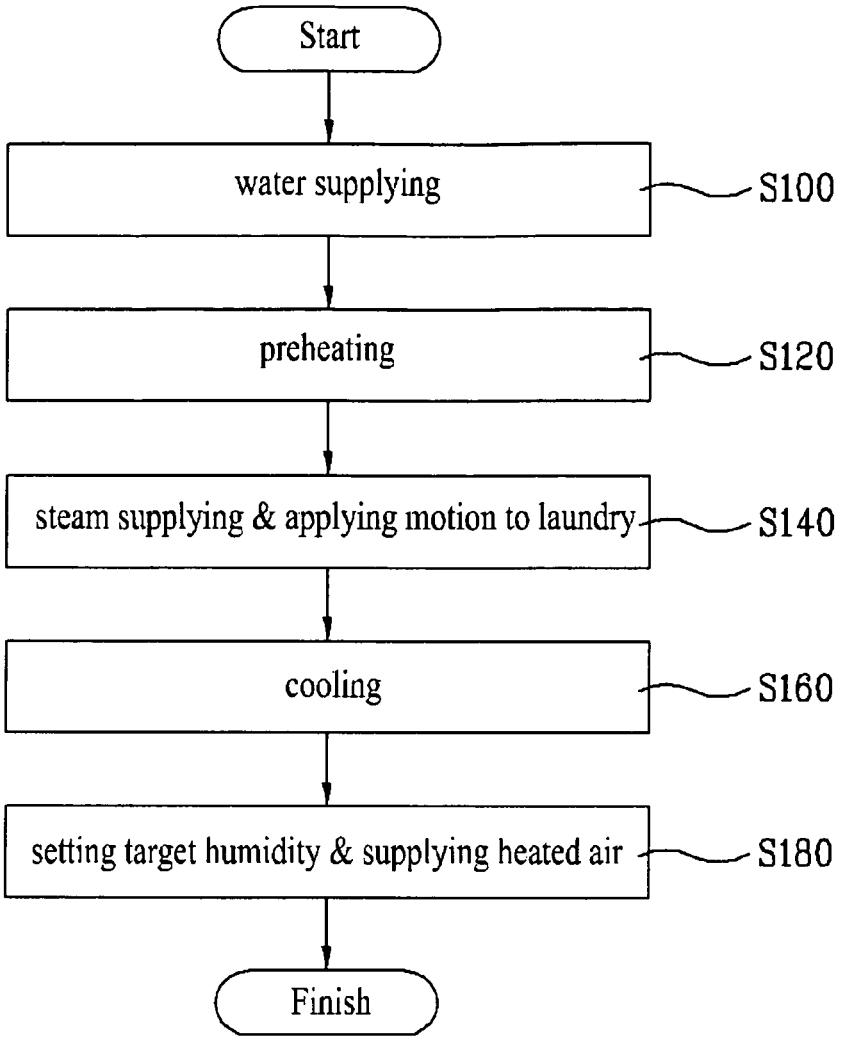
FIG. 10 is a flow chart illustrating a control method according to another embodiment of the present invention.

FIG. 10 is a flow chart illustrating a control method according to another embodiment of the present invention. The control method of FIG. 10 includes a preheating step preheating the accommodating space which is performed before the step of supplying steam/applying the motion to the laundry (S140), compared with the control method according to the above embodiment. As follows, the difference will be described.

The control method according to this embodiment includes a preheating step (S120) increasing the temperature of the accommodating space 12 to a predetermined value by supplying heated air to the accommodating space 12, before supplying water to the steam generating device and supplying steam to the accommodating space 12. if the temperature of the accommodating space 12 is too low when supplying steam thereto, the effects of wrinkle removal, deodorization and static electricity prevention, which are achieved by using the steam, may deteriorate. Because of that, the control part increases the temperature of the accommodating space 12 up to a predetermined temperature, for example, 15° C. to 25° C. In this case, the control part drives the heat pump and it supplies heated air to the accommodating space, to increase the temperature of the accommodating space 12.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

According to the control method having the above configuration and steps enables drying for the laundry to be performed by supplying air or heated air to the laundry.

The invention claimed is:

1. A control method of a laundry treatment apparatus configured to supply steam and/or heated air to an accommodating space accommodating laundry therein, the control method comprising:

a water supplying step supplying water to a moisture generating device configured to supply steam;

a steam supplying/applying a predetermined motion to the laundry step heating the water to supply steam to the accommodating space and applying a motion to the laundry for a predetermined time period simultaneously;

a cooling step cooling the accommodating space; and a drying step setting a target relative humidity according to a selected course and supplying heated air to the accommodating space, wherein the drying step sets the target relative humidity according to a relative humidity of the accommodating space accommodating the laundry therein.

2. The control method of claim 1, wherein the drying step comprises, a humidity measuring step measuring the relative humidity of the accommodating space accommodating the laundry therein;

a target humidity determining step determining the target relative humidity according to the relative humidity measured in the humidity measuring step and the selected course; and a heated air supplying step supplying heated air to the accommodating space according to the target relative humidity.

3. The control method of claim 2, wherein the target humidity determining step determines the target relative humidity having a predetermined difference from the measured relative humidity.

4. The control method of claim 2, wherein the target humidity determining step comprises a step determining a target maximum humidity and a target minimum humidity according to the selected course.

5. The control method of claim 4, wherein the target maximum humidity and the target minimum humidity are preset according to the selected course.

6. The control method of claim 4, wherein the target maximum humidity and the target minimum humidity are preset, regardless of the relative humidity measured initially.

7. The control method of claim 4, wherein the heated air supplying step supplies the heated air according to at least one of the target relative humidity, the target maximum humidity and the target minimum humidity.

8. The control method of claim 7, wherein completion of the heated air supplying step is determined according to the target maximum humidity when the target relative humidity is reached.

9. The control method of claim 8, wherein the heated air supplying step is completed when the target maximum humidity is reached.

10. The control method of claim 7, wherein completion of the heated air supplying step is determined according to the target minimum humidity when the target relative humidity is not reached.

11. The control method of claim 10, wherein the heated air supplying step is completed when the target minimum humidity is reached in case of the target relative humidity not being reached.

12. The control method of claim 2, further comprising:

a stabilizing step stabilizing a sensor configured to measure the relative humidity, the stabilizing step performed before the humidity measuring step.

13. The control method of claim 12, wherein the stabilizing step supplies heated air for 3 to 5 minutes.

14. The control method of claim 2, wherein the humidity measuring step measures the relative humidity for a predetermined time period, to determine an average value of the measured values as relative humidity.

15. The control method of claim 2, wherein the target humidity determining step comprises a step of adjusting the target relative humidity according to a kind of the laundry.

* * * * *